US005970117A

United States Patent [19]

Basinger

[11] Patent Number: 5,970,117

[45] Date of Patent: Oct. 19, 1999

[54] X-RAY SOURCE HAVING REMOVABLE CATHODE ASSEMBLY

[75] Inventor: Thomas J. Basinger, Ypsilanti, Mich.

[73] Assignee: Pilot Industries, Inc., Dexter, Mich.

[21] Appl. No.: 09/095,291

[22] Filed: Jun. 10, 1998

[51] Int. Cl.[6] ..... H01J 35/06

[52] U.S. Cl. ..... 378/136; 378/121

[58] Field of Search ..... 378/136, 121

[56] References Cited

U.S. PATENT DOCUMENTS 4,560,897 12/1985 Hudgens ..... 378/136

*Primary Examiner*—Craig E. Church
*Attorney, Agent, or Firm*—Gifford, Krass, Groh, Sprinkle,Anderson & Citkowski, P.C.

[57] ABSTRACT

An x-ray source of the type used in medical or inspection devices having a first and second housing part which are detachably secured together to define an interior chamber for the housing. A plurality of power feeds is secured to the first housing part wherein each power feed has an elongated conductor extending into the chamber such that the conductors are parallel to each other. A removable cathode assembly includes a mounting plate having a plurality of tubular standoffs constructed of an electrically insulating material. These standoffs, furthermore, are secured to the mounting plate and protrude outwardly therefrom so that one standoff is associated with and registers with the conductor for each power feed. With the cathode assembly mounted in the housing chamber, the cathode assembly is secured to the housing by a threaded member extending through a cap secured to each standoff such that one end of the threaded member frictionally engages the conductor in its associated standoff thus securing the cathode assembly to the housing.

5 Claims, 2 Drawing Sheets

X-RAY SOURCE HAVING REMOVABLE CATHODE ASSEMBLY

BACKGROUND OF THE INVENTION

I. Field of the Invention

The present invention relates generally to x-ray sources and, more particularly, to such an x-ray source with a removable cathode assembly.

II. Description of the Prior Art

There are many different types of x-ray sources utilized in medical and inspection devices. These x-ray sources all comprise a housing having an interior chamber which is maintained in a near absolute vacuum.

A cathode assembly is fixedly mounted within the chamber which, upon activation, generates free electrons. These free electrons are then accelerated toward an anode contained in the housing so that, once the electrons strike the anode, x-rays are generated. The generated x-rays then pass out through a window substantially transparent to x-rays and exteriorly of the housing.

One disadvantage of these previously known x-ray sources is that the cathodes, by their very nature, become depleted after extended use. Once the cathode has been depleted, the entire x-ray source is discarded and replaced with a new x-ray source.

A still further disadvantage of these prior art devices is that different cathode designs are required for different applications. This has previously required the use of entire different x-ray sources for different applications.

This previously known practice of discarding the x-ray source after depletion of the cathode as well as the use of different x-ray sources for different types of applications, however, is extremely wasteful. In particular, many components of the x-ray source, e.g. the housing, anode and associated components, all exhibit useful lives greatly in excess of the cathode assembly. These other components are also costly.

SUMMARY OF THE PRESENT INVENTION

The present invention provides an x-ray source which overcomes all of the above-mentioned disadvantages of the previously known devices.

In brief, the x-ray source of the present invention comprises first and second housing parts which are removably secured together so that the housing parts define an interior chamber. One of the housing parts includes a through opening while a window substantially transparent to x-rays is sealingly disposed across the housing opening. An anode is also contained within the housing so that at least a portion of the anode is open to the housing chamber opposite from the window.

A plurality of power feeds, each including an elongated electrical conductor, are secured to the housing so that a portion of each conductor extends into the housing chamber. Furthermore, these conductors are arranged such that the conductors are generally spaced apart and parallel to each other.

An improved cathode assembly is also disclosed having a generally circular mounting plate. A plurality of tubular standoffs are secured to the mounting plate so that the standoffs protrude outwardly from one side of the plate. These standoffs are constructed of an electrically insulating material, such as ceramic, and are positioned on the plate so that one standoff registers with each electrical conductor.

The plate is positioned within the housing chamber so that one conductor extends through its associated standoff and so that a first end of each standoff abuts against its associated power feed. Means, such as a set screw, are then used to detachably secure the conductors to a second end of its associated standoff such that the mounting plate is detachably secured within the housing chamber. An electron emitter is then secured to the mounting plate which, upon activation, emits electrons. These electrons are attracted to the anode so that x-rays generated by impact of the electrons on the anode emit outwardly through the housing opening.

Since the cathode assembly is detachably secured to the conductors of the power feeds, the cathode assembly can be easily replaced whenever desired or required. Furthermore, different cathode assemblies can be used when different x-ray characteristics from the x-ray source are desired.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
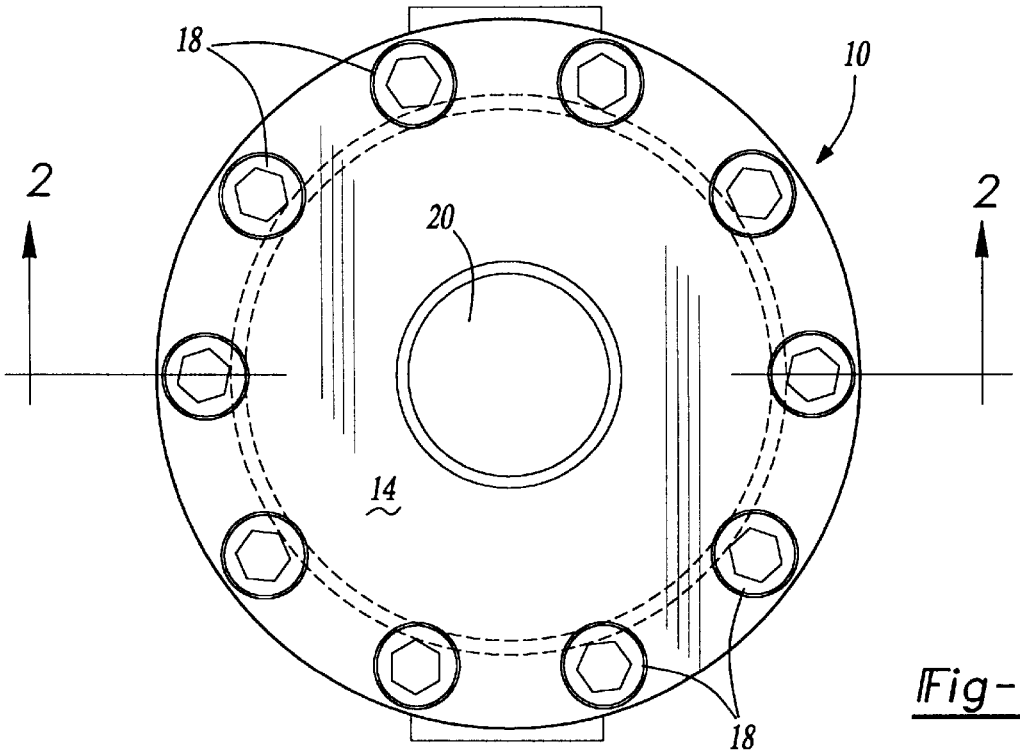
FIG. 1 is a top plan view illustrating a preferred embodiment of the present invention.
Figure 2:
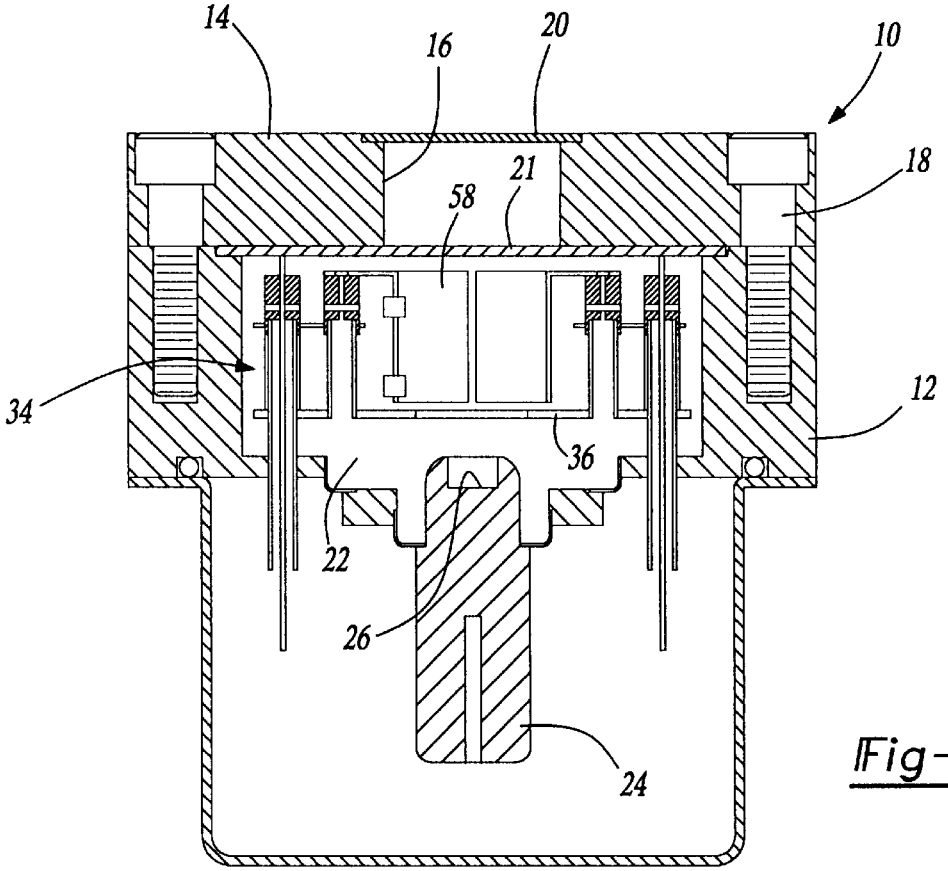
FIG. 2 is a longitudinal sectional view taken substantially along line 2—2 in FIG. 1.

With reference first to FIGS. 1 and 2, a preferred embodiment of the x-ray source 10 of the present invention is there shown and comprises a first housing part 12 and a second housing part 14. Both housing parts 12 and 14 are generally circular in cross-sectional shape while the second housing part 14 includes a central through opening 16 formed therethrough.

As best shown in FIG. 2, the housing parts 12 and 14 are detachably secured together by a plurality of circumferentially extending bolts 18 extending through the second housing part 14 and threadably engaging the first housing part 12. Additionally, a window 20 constructed of a material substantially transparent to x-rays, such as beryllium, is attached to housing part 14 that is to be vacuum tight.

With the housing parts 12 and 14 secured together and sealed with a metal gasket 21, typically used in UHV equipment, the housing parts 12 and 14 define an interior chamber 22. An anode 24 is secured to the first housing part 12 so that a portion 26 of the anode 24 is open to the housing chamber 22 opposite from the opening 16 on the second housing part 14. Additionally, the chamber 22 is maintained at near perfect vacuum by a pumping device.

Figure 5:
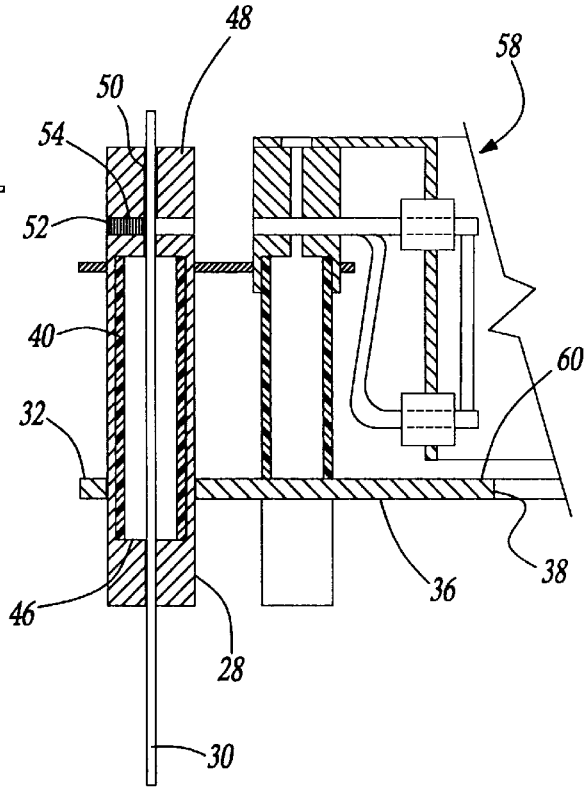
FIG. 5 is a fragmentary sectional view illustrating a portion of the preferred embodiment of the present invention.

With reference now to FIGS. 2 and 5, a plurality of power feeds 28 are secured to the first housing part 12. Each power feed 28 includes an elongated electrical conductor 30 secured to it so that the conductors 30 of the power feeds 28 extend into the housing chamber 22 and are generally parallel to each other. Each conductor 28, furthermore, is sealingly secured to the first housing part 12, such as by welds at 32 (FIG. 5) in order to maintain the integrity of the sealed interior chamber 22.

Figure 3:
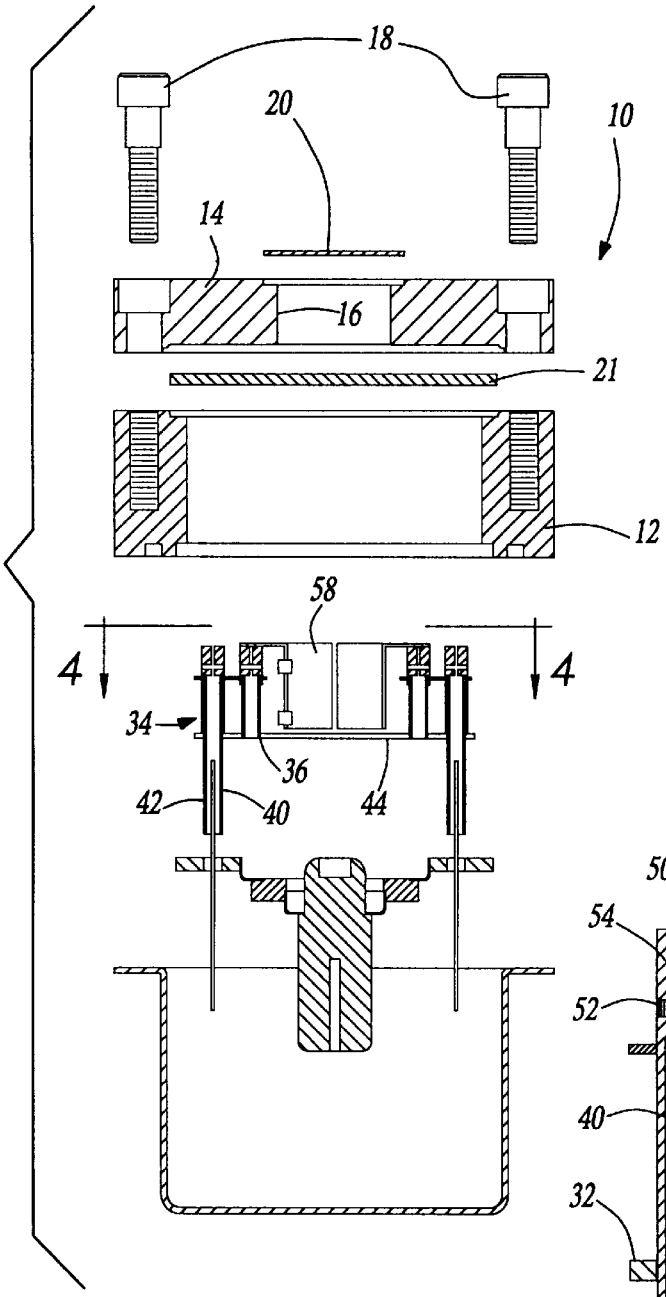
FIG. 3 is a longitudinal exploded view illustrating a preferred embodiment of the present invention.
Figure 4:
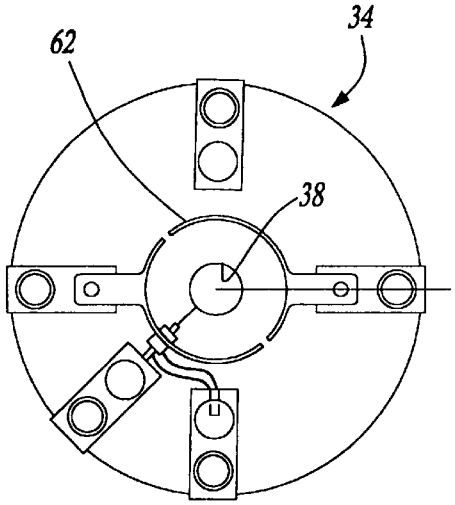
FIG. 4 is a view taken substantially along line 4—4 in FIG. 3 and with parts removed for clarity.

With reference now to FIGS. 2–4, the x-ray source 10 further includes a cathode assembly 34. The cathode assembly 34 includes an annular mounting plate 36 having an opening 38 formed through it. The mounting plate 36 is preferably constructed of a metallic material.

A plurality of standoffs 40 are secured to the mounting plate 36 so that a portion 42 of each standoff 40 protrudes outwardly from one side 44 of the mounting plate 36 by a preset distance. Each standoff 40, furthermore, is constructed of an electrically insulating material, such as ceramic.

As best shown in FIG. 3, the standoffs 40 are secured to the mounting plate 36 such that one standoff 40 registers with one electrical conductor 30 of each power feed 28. Thus, as shown in FIGS. 2 and 5, when the cathode assembly 34 is positioned within the housing chamber 22 such that the electrical conductors 30 register with their associated standoffs 40, the electrical conductors 30 extend entirely through the standoffs 40. An inner end 46, furthermore, of each standoff 40 abuts against the power feed 28 to thereby position the mounting plate 36 a predetermined distance away from the anode portion 26.

With reference now particularly to FIG. 5, a metallic cap 48 is secured to the other end of each standoff 40 by any conventional means. Each cap 48 includes an axial screw bore 50 through which its associated conductor 30 extends as well as a transverse threaded bore 52.

The electrical conductors 30 of the power feeds 28 are dimensioned so that, with the cathode assembly 38 positioned in the housing chamber such that the conductors 30 extend through the standoffs, the conductors 30 also extend through at least a portion of the cap 48 on each standoff 40. The cathode assembly 34 is then secured to the housing by a threaded fastener 54, such as a set screw, which threadably engages the bore 52 and has an inner end which abuts against the conductor 30. Upon tightening of the threaded fastener 54, the cap 48 is detachably secured to the conductor 30 thereby securing the cathode assembly 34 to the housing part 12.

An electron emitter 58 is also secured to the mounting plate 36, preferably on the side 60 of the mounting plate 36 opposite from the anode 24. The electron emitter 58 may be of any conventional construction, but preferably includes semicircular plates 62 (FIG. 4) disposed concentrically around the mounting plate opening 38. Appropriate electrical connections are made between the conductors 30 of the power feeds 28 and the election emitter 58 so that, upon, electrical activation, the emitter 58 emits elections.

With the cathode assembly 34 positioned within the housing chamber 22 as previously described, the housing opening 16, plate opening 38 and anode portion 26 are all aligned with each other. Thus, upon electrical activation of the electron emitter 58, electrons pass through the opening 38 and impinge against the anode portion 26. X-rays are then generated which then travel out through the opening 38, window 20 and housing opening 16 in the desired fashion.

A primary advantage of applicant's invention is that the cathode assembly 34 is removably secured to the housing. Consequently, whenever the cathode assembly becomes depleted, or a different cathode assembly is desired for different x-ray characteristics, the cathode assembly 34 may be easily replaced with a new and/or different cathode assembly.

It can thus be seen that the present invention provides a novel x-ray source with a removable cathode assembly. Having described my invention, however, many modifications thereto will become apparent to those skilled in the art to which it pertains without deviation from the spirit of the invention as defined by the scope of the appended claims.

I claim:

1. An x-ray source of the type having a first housing part and a second housing part, means for removably securing said housing parts together so that said housing parts define an interior chamber therebetween, the improvement comprising:

a plurality of power feeds secured to said first housing part, each power feed having an elongated conductor extending into said chamber so that said conductors are parallel to each other, a removable cathode assembly comprising a mounting plate, a plurality of tubular standoffs secured to said mounting plate and protruding outwardly from one side thereof, said standoffs being constructed of an electrical insulating material and said standoffs being positioned on said plate so that one standoff registers and is associated with each power feed, said plate being positioned in said housing chamber so that one conductor extends through its associated standoff and so that a first end of each standoff abuts against its associated power feed, means for detachably securing each of said conductors to a second end of its associated standoff, and an electron emitter secured to the plate.

2. The invention as defined in claim 1 and comprising a plurality of metallic caps, one metallic cap being secured to said other end of each standoff, and wherein said means for detachably securing said conductors comprises means for detachably securing each conductor to the cap on its associated standoff.

3. The invention as defined in claim 2 wherein said detachable securing means comprises a threaded fastener which threadably engages a threaded bore in said cap such that one end of each threaded member abuts against the conductor extending through the standoff associated with each cap.

4. The invention as defined in claim 1 wherein said electron emitter is mounted to the other side of said plate.

5. The invention as defined in claim 1 in which one housing includes a window substantially transparent to x-rays, and wherein said plate includes a central opening which registers with said opening.

* * * * *